US006660976B1

(12) United States Patent
Bianchi

(10) Patent No.: US 6,660,976 B1
(45) Date of Patent: Dec. 9, 2003

(54) DEVICE FOR CONTROLLING THE SERVICE LOADS OF AN ELECTRIC HOUSEHOLD APPLIANCE, IN PARTICULAR A REFRIGERATOR

(75) Inventor: Raoul Bianchi, Via Monte Grappa (IT)

(73) Assignee: ITW Industrial Components S.r.l., Milan (IT)

( * ) Notice: Subject to any disclaimer, the term of this patent is extended or adjusted under 35 U.S.C. 154(b) by 0 days.

(21) Appl. No.: 09/856,354

(22) PCT Filed: Nov. 24, 1999

(86) PCT No.: PCT/IT99/00383

§ 371 (c)(1),
(2), (4) Date: Aug. 27, 2001

(87) PCT Pub. No.: WO00/31480

PCT Pub. Date: Jun. 2, 2000

(30) Foreign Application Priority Data

Nov. 24, 1998 (IT) ..... MI98A2534

(51) Int. Cl.[7] ..... H05B 3/02

(52) U.S. Cl. ..... 219/507; 219/511; 219/512; 219/505; 337/340

(58) Field of Search ..... 62/154–155, 234; 337/101, 311, 340, 43, 359; 200/38 R, 452, 574, 409; 307/112, 141; 361/24, 26; 318/783; 219/494, 505, 511, 512, 507

(56) References Cited

U.S. PATENT DOCUMENTS

| | | | | |
|---|---|---|---|---|
| 1,959,659 A | | 5/1934 | Colbie | |
| 2,970,454 A | | 2/1961 | Everard et al. | |
| 3,202,842 A | | 8/1965 | Sherwood | |
| 3,688,060 A | | 8/1972 | Risk | |
| 3,902,151 A | | 8/1975 | Hall et al. | |
| 4,169,358 A | | 10/1979 | Hansen et al. | |
| 5,053,908 A | * | 10/1991 | Cooper et al. | 361/24 |

FOREIGN PATENT DOCUMENTS

| | | |
|---|---|---|
| EP | 0 234 189 | 9/1987 |
| GB | 1 225 302 | 3/1971 |

* cited by examiner

*Primary Examiner*—Tu Ba Hoang
(74) *Attorney, Agent, or Firm*—Lowe Hauptman Gilman & Berner LLP

(57) ABSTRACT

A control unit (3) for controlling an electric household appliance, e.g. a refrigerator, is connected in series with a positive temperature coefficient (PTC) resistive unit (4) which, when supplied with electric current, generates sufficient heat to activate a thermally activated actuating element (6) for selectively turning on/off respective auxiliary switches (9) of the electric household appliance. The thermally activated actuating element (6) includes a temperature-deformable element (7), e.g. a bimetallic plate, the deformation of which is transmitted by kinematic links (10) to a camshaft (8), the cams (12) of which cooperate with the auxiliary switches (9) of the electric household appliance to selectively turn on/off the auxiliary switches (9).

20 Claims, 2 Drawing Sheets

DEVICE FOR CONTROLLING THE SERVICE LOADS OF AN ELECTRIC HOUSEHOLD APPLIANCE, IN PARTICULAR A REFRIGERATOR

TECHNICAL FIELD

The present invention relates to a device for controlling the service loads of an electric household appliance, in particular a refrigerator.

BACKGROUND ART

As is known, many household appliances require systems for regulating and controlling one or more operating functions, which are activated or deactivated according to various operating conditions. Such is the case, for example, of a refrigerator compressor, which calls for a control system which, in response to temperature variations measured inside the refrigerator, turns the compressor on or off under the control, for example, of a mechanical thermostat. The compressor supply circuit normally comprises two activating branches, which are active at the start-up (or "launch") stage and the normal running ("operating") stage respectively: in which case, a positive temperature coefficient PTC resisting unit is used to regulate current flow through the launch branch, and the mechanical thermostat for regulating current flow through the operating branch.

A major drawback of control systems of this type is the relatively high energy consumption involved, which is mainly due to the presence of the continuously operating PTC unit, and to the difficulty in regulating the mechanical thermostat.

Employing an electronic as opposed to mechanical thermostat and other types of relays in place of PTC units permits a certain, albeit relatively small, reduction in consumption, but calls for the use of more complex, more expensive components.

DISCLOSURE OF INVENTION

It is an object of the present invention to provide a device for controlling the service loads of an electric household appliance, which, though cheap and easy to produce, provides for low-energy operation and long-term reliability.

According to the present invention, there is provided a device for controlling the service loads of an electric household appliance, in particular a refrigerator, comprising a control unit for controlling service functions of said electric household appliance, and a positive temperature coefficient (PTC) resisting unit connected in series with said control unit; characterized by also comprising thermally activated actuating means for selectively connecting/disconnecting respective auxiliary switches of said service loads; said PTC unit being located close to said thermally activated actuating means, and generating, when supplied with electric current, sufficient heat to activate said thermally activated actuating means.

Said PTC unit used to thermally activate said actuating means is advantageously the same one used to directly regulate operation of at least one power application of said electric household appliance.

More specifically, said thermally activated actuating means comprise at least one temperature-deformable element; at least one movable control member for controlling said auxiliary switches; and kinematic connecting means between said deformable element and said movable control member.

In a preferred embodiment, the movable control member is a camshaft, the cams of which cooperate with said respective auxiliary switches of said loads to selectively connect/disconnect the auxiliary switches; at least one cam of said camshaft is also used to determine the angular position of the camshaft.

The device according to the invention preferably also comprises a control circuit for controlling the PTC unit and for cyclically cutting off supply to the PTC unit, e.g. by means of an electronic switch interposed between the control unit and the PTC unit, once sufficient heat has been generated by the PTC unit to activate said thermally activated actuating means.

The device according to the invention is therefore straightforward and reliable, does not call for particularly complex and/or high-cost components, and, as compared with known control systems, provides for significant in-service energy saving. Supply to the PTC unit, in fact, may be cut off at the end of each cycle to activate the service load (or loads), thus reducing overall consumption of the device. The device according to the invention is also highly flexible, by controlling and regulating numerous different service functions of the electric household appliance to which it is applied. For example, in the case of a refrigerator, in addition to the compressor, the device may also control the interior light, the fan, etc., and this using only one PTC unit, in particular, the same one used to control operation of the compressor. For which purpose, in fact, the movable control member need simply be provided with a number of cams for controlling corresponding switches for the various loads. One or more cams may also advantageously be used to determine the angular position of the movable control member, so that the control unit is always in a condition to determine the position of the movable control member and, hence, the operating conditions of the system, and may also intervene in the event of failure to activate any of the service functions.

Moreover, the device according to the invention enables all the heat-generating components to be located as best suited to the application in question. More specifically, in the case of a refrigerator, such components may be located away from the code region, e.g. directly on the compressor, thus improving the overall efficiency of the appliance.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
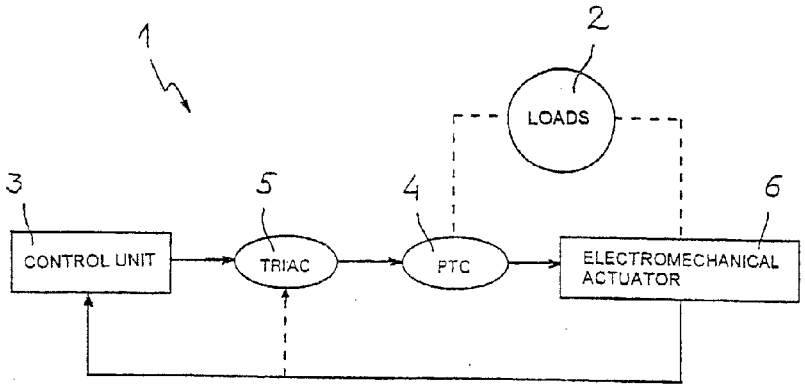
FIG. 1 shows a block diagram of the general operating principle of a device for controlling the service loads of an electric household appliance in accordance with the invention.

Number 1 in FIG. 1 indicates as a whole a device for controlling the service loads—indicated schematically by "users" 2 in FIG. 1—of an electric household appliance, e.g. a refrigerator. Control device 1 comprises a control unit 3, of any known type, for controlling the service functions of the refrigerator; a positive temperature coefficient resisting unit 4 (substantially known, and referred to hereinafter simply as a PTC unit) connected in series with control unit 3; and an electronic switch 5, e.g. a known TRIAC switch, interposed between control unit 3 and PTC unit 4.

According to the invention, control device 1 also comprises thermally activated actuating means 6 for selectively connecting and disconnecting service loads 2 of the refrigerator. Operation of actuating means 6 and consequent selective activation of one or more of service loads 2 are controlled by PTC unit 4 as indicated by control unit 3.

Figure 2:
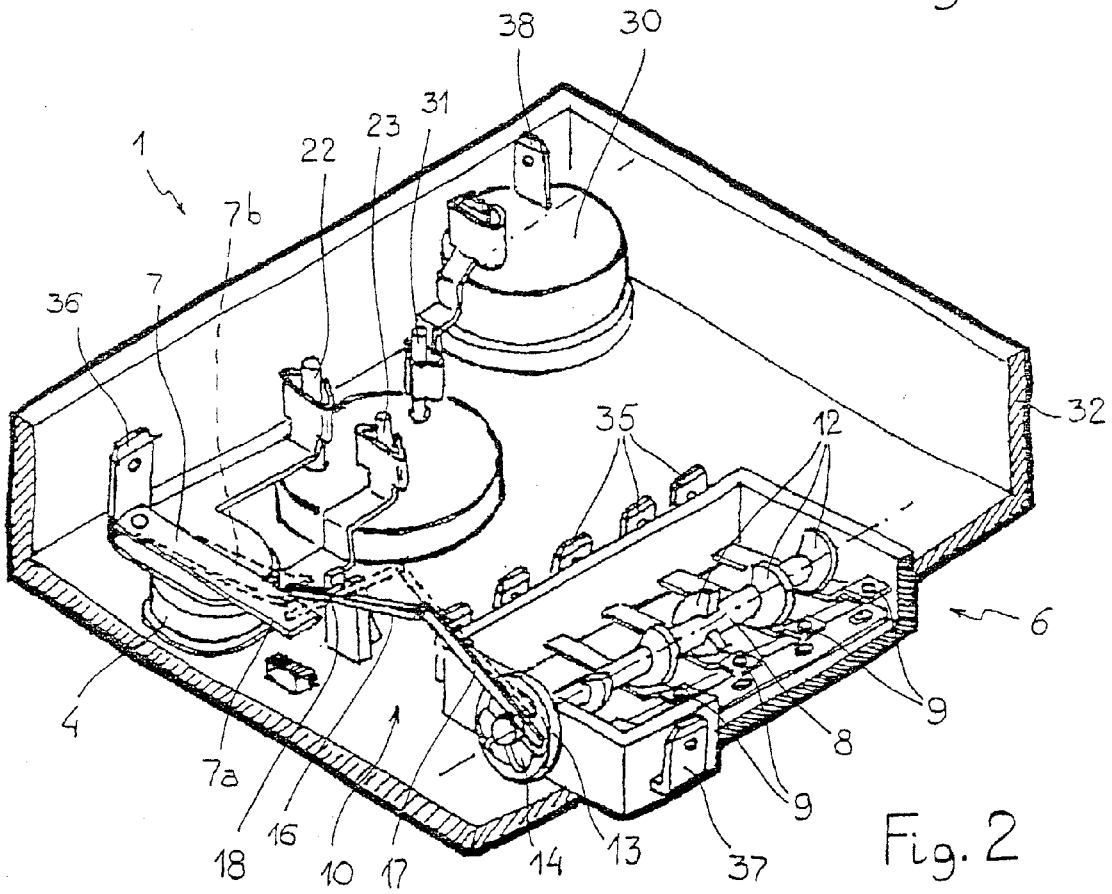
FIG. 2 shows, schematically, a preferred embodiment of the device according to the invention.
Figure 3:
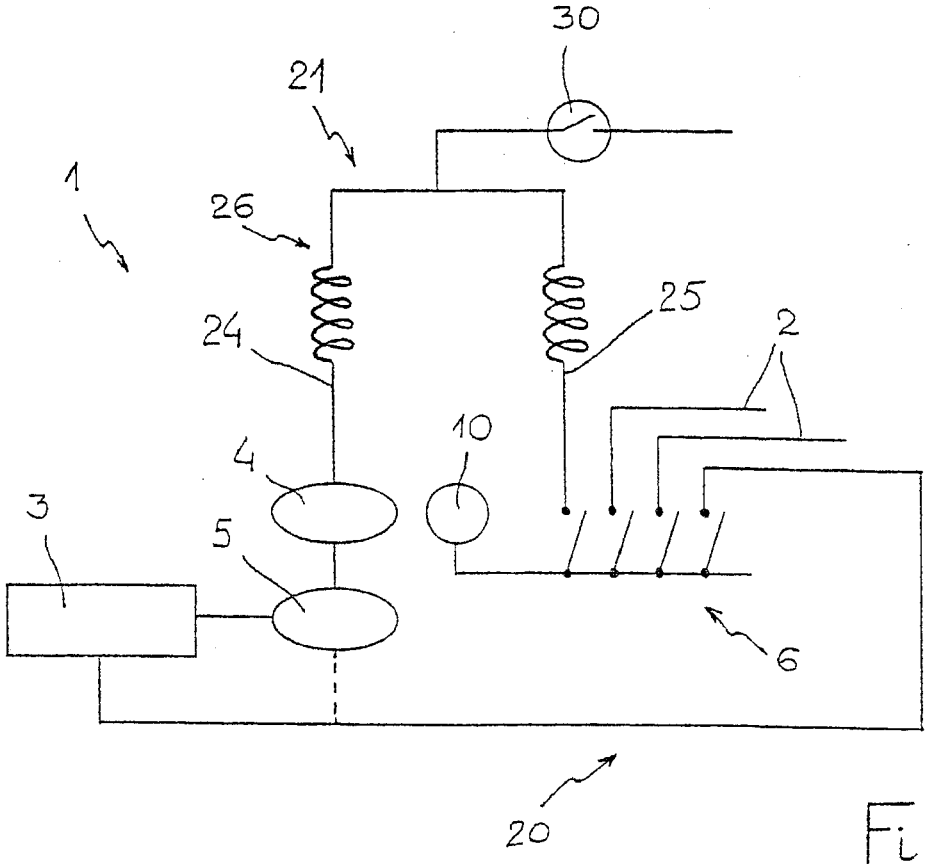
FIG. 3 shows, schematically, a circuit incorporating the FIG. 2 device.
Figure 4:
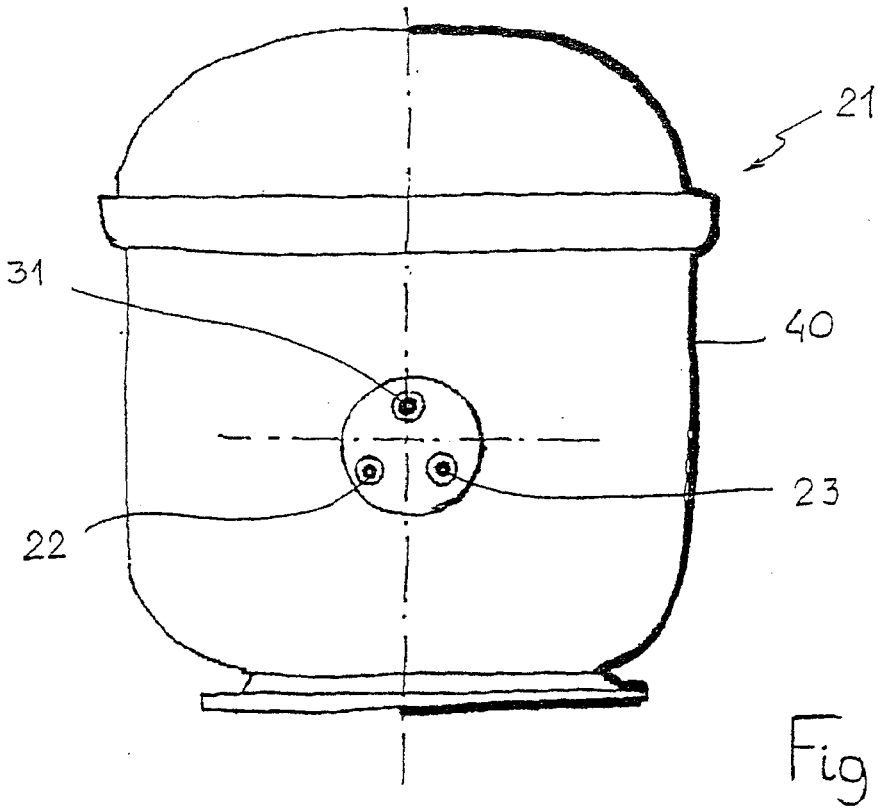
FIG. 4 shows a possible application of the FIGS. 2 and 3 device.

In the preferred embodiment shown in detail in FIGS. 2, 3 and 4, thermally activated actuating means 6 comprise a temperature-deformable element 7; at least one movable control member 8 for activating one or more auxiliary switches 9 for service loads 2; and kinematic connecting means 10 between element 7 and movable control member 8.

PTC unit 4 is located close to thermally activated actuating means 6, and, when supplied with electric current, generates sufficient heat to activate actuating means 6.

In the non-limiting example shown in FIG. 2, temperature-deformable element 7 is defined by a known bimetallic plate facing PTC unit 4, and selectively assumes a first shape 7*a* (shown by the continuous line in FIG. 2) below a predetermined temperature, and at least one second shape 7*b* (shown schematically by the dash line in FIG. 2) above said predetermined temperature. The amount of heat generated by PTC unit 4 when supplied with current is sufficient to bring the temperature of element 7 (located a small distance from PTC unit 4) above said predetermined temperature and so change the shape of element 7.

Movable control member 8 is a camshaft rotating about a predetermined axis of rotation, and the cams 12 of which cooperate with auxiliary switches 9 of service loads 2 to selectively connect or disconnect the loads. One end of camshaft 8 is fitted with a wheel 13 having radial lobes 14 with a predetermined spacing; kinematic connecting means 10 comprise a first lever 16 and a second lever 17 hinged to each other; first lever 16 is hinged at an intermediate point 18 to a fixed support, and at opposite longitudinal ends to second lever 17 and to one end of deformable element 7; and second lever 17 exerts thrust successively on each of radial lobes 14 of wheel 13 to rotate camshaft 8 by a predetermined angle, substantially corresponding to the spacing of radial lobes 14, whenever temperature-deformable element 7 changes from first shape 7*a* to second shape 7*b*. Kinematic connecting means 10 preferably also comprise known click actuating means (e.g. integral with levers 16, 17 or deformable element 7, and not shown for the sake of simplicity) for click rotating camshaft 8.

Control device 1 also comprises a control circuit 20 for controlling PTC unit 4 and for cyclically cutting off supply to PTC unit 4 once sufficient heat has been generated by PTC unit 4 to activate thermally activated actuating means 6. Preferably, control circuit 20 comprises the TRIAC-type electronic switch 5 interposed between control unit 3 and PTC unit 4, and thermally activated actuating means 6 supply electronic switch 5 with a signal, either via control unit 3 (see the circuit indicated by the continuous line in FIG. 3) or directly (dash line in the FIG. 3) to cut off supply to PTC unit 4.

Control circuit 20 may also advantageously be used to supply control unit 3 with a signal indicating the angular position of camshaft 8, e.g. detected by means of one or more of cams 12.

In the non-limiting example shown in FIGS. 2 to 4, control device 1 is connected to a known compressor 21 (not shown in detail for the sake of simplicity) by two conducting pins 22, 23 connected respectively to a start-up branch 24 and an operating branch 25 of a substantially known supply circuit 26 for supplying the compressor, and which is shown only schematically in FIG. 3. Control device 1 also comprises a known thermal protector 30 connected to supply circuit 26 of compressor 21 by a further conducting pin 31.

The whole of control device 1, including thermal protector 30, may be housed in a casing 32, from which project the various contacts for electrically connecting control device 1, e.g. conducting pins 22, 23, 31 (for connection to compressor 21), terminals 35 for connection to service loads 2, and supply contacts 36, 37, 38, e.g. connected respectively to PTC unit 4, to actuating means 6, and to the output of thermal protector 30. Casing 32 may then be fitted directly to an outer casing 40 of compressor 21 (FIG. 4) in which the connections for the three conducting pins 22, 23, 31 are formed.

Control device 1 according to the invention operates as follows.

When control unit 3 detects the need to vary the operating condition of a service function 2 (or when activation of the service function is commanded directly by the user), a signal is sent to normally-open electronic switch 5, which closes to permit current flow to PTC unit 4; PTC unit 4 is heated, and the increase in temperature changes the shape of temperature-deformable element 7. Temperature-deformable element 7 is hinged to first lever 16 so as to produce a predetermined angular displacement of first lever 16 and a corresponding displacement of second lever 17 hinged to first lever 16; and second lever 17 in turn exerts thrust on one of radial lobes 14 of wheel 13 to rotate wheel 13 and camshaft 8 by a predetermined angle (corresponding to the spacing of radial lobes 14).

Depending on the position and configuration of cams 12, the rotation of camshaft 8 closes or opens switches 9 to activate or deactivate the corresponding service functions 2 (including, in particular, the power application defined by compressor 21).

Once camshaft 8 is rotated the predetermined amount, corresponding to the translation of element 7 on changing from shape 7*a* to shape 7*b*, control unit 3 opens electronic switch 5 to cut off supply to PTC unit 4: temperature-deformable element 7 is restored to shape 7*a*, and levers 16, 17 to their original positions, pending further current flow through PTC unit 4 to rotate camshaft 8 and activate actuating means 6.

Clearly, changes may be made to the device as described herein without, however, departing from the scope of the accompanying Claims.

What is claimed is:

1. A device (1) for controlling service loads (2) of an electric household appliance, said device comprising:

a control unit (3);

thermally activated actuating means (6) for selectively connecting/disconnecting respective auxiliary switches (9) of said service loads (2); and a positive temperature coefficient (PTC) resistive unit (4) connected in series with said control unit (3) and located close to said thermally activated actuating means (6) for generating, when supplied with electric current, sufficient heat to activate said thermally activated actuating means (6);

wherein said thermally activated actuating means (6) comprise:

at least one temperature deformable element (7) which selectively assumes a first shape (7*a*) below a predetermined temperature, and at least one second shape (7*b*) above said predetermined temperature;

at least one movable control member (8) for controlling said auxiliary switches (9) and rotating with respect to a predetermined axis of rotation; and kinematic connecting means (10) between said temperature deformable element (7) and said movable control member (8) for imparting to said movable control member (8) a rotation of a predetermined angle whenever said temperature deformable element (7) changes from said first shape (7*a*) to said at least one second shape (7*b*).

2. A device as claimed in claim 1, wherein said PTC unit (4) used to thermally activate said thermally activated actuating means (6) is the same one used to directly regulate operation of at least one power application (21) of said electric household appliance.

3. A device as claimed in claim 1, wherein said kinematic connecting means (10) comprise click actuating means for producing a clicking movement of said movable control member (8).

4. A device as claimed in claim 1, further comprising detecting means for detecting an angular position of said movable control member (8);

said detecting means being connected to said control unit (3) to supply the control unit with a signal indicating the angular position of said movable control member (8).

5. A device as claimed in claim 1, wherein said movable control member is a camshaft (8) having cams (12) which cooperate with the respective auxiliary switches (9) to selectively connect/disconnect the service loads.

6. A device as claimed in claim 5, wherein said camshaft (8) has at least one cam (12) for determining an angular position of said camshaft (8).

7. A device as claimed in claim 6, wherein said camshaft (8) is fitted with a wheel (13) having radial lobes (14) with a predetermined spacing;

said kinematic connecting means (10) comprising a first lever (16) and a second lever (17) hinged to each other;

the first lever (16) being hinged at an intermediate point (18) to a fixed support, and being hinged at respective ends to said second lever (17) and to said temperature deformable element (7); and said second lever (17) exerting thrust successively on each of the radial lobes (14) of said wheel to impart said rotation of the predetermined angle to said camshaft (8).

8. A device as claimed in claim 7, wherein, whenever said temperature deformable element (7) assumes said at least one second shape (7*b*), said kinematic connecting means (10) impart to said camshaft (8) a rotation of an angle substantially corresponding to the spacing of said radial lobes (14).

9. A device as claimed in claim 8, wherein said temperature deformable element (7) cooperates with said first lever (16) to produce a predetermined angular displacement of said first lever (16) about said intermediate point (18), and a corresponding displacement of said second lever (17) hinged to said first lever (16);

said second lever (17) exerting thrust successively on each of said radial lobes (14) of said wheel (13) to impart said rotation of the predetermined angle to said camshaft (8).

10. A device as claimed in claim 1, further comprising a control circuit (20) for controlling said PTC unit (4) and for cyclically cutting off supply to said PTC unit (4) once sufficient heat has been generated by the PTC unit to activate said thermally activated actuating means (6).

11. A device as claimed in claim 10, wherein said control circuit (20) comprises an electronic switch (5) interposed between said control unit (3) and said PTC unit (4) to selectively cut off supply to said PTC unit (4);

said thermally activated actuating means (6) supplying a signal to said electronic switch (5) to cut off supply to said PTC unit (4).

12. A device for controlling an electric household appliance, said device comprising:

a control unit;

a thermally activated actuator for selectively turning on or off a plurality of switches of said electric household appliance, said thermally activated actuator comprising at least one temperature deformable element which selectively assumes a first shape below a predetermined temperature, and at least one second shape above said predetermined temperature;

at least one moveable control member for controlling the switches of said electric household appliance, said moveable control member being rotatable about an axis of rotation; and a kinematic linkage between said temperature deformable element and said movable control member for causing said movable control member to rotate a predetermined angle about the axis of rotation whenever said temperature deformable element deforms from said first shape to said at least one second shape; and a positive temperature coefficient (PTC) resistive element connected in series with said control unit and located in a proximity of said at least one temperature deformable element for generating, when supplied with electric current, sufficient heat to cause said temperature deformable element to deform from said first shape to said at least one second shape.

13. A device as claimed in claim 12, wherein said kinematic linkage comprises click actuating means for producing a clicking rotational movement of said movable control member.

14. A device as claimed in claim 12, further comprising a feedback from said movable control member to said control unit for supplying the control unit with a signal indicating an angular position of said movable control member.

15. A device as claimed in claim 12, wherein said movable control member is a camshaft having cams adapted to turn on or off the switches of said electric household appliance.

16. A device as claimed in claim 14, wherein said movable control member is a camshaft having cams adapted to turn on or off the switches of said electric household appliance, at least one of said cams providing the signal indicating the angular position of said camshaft.

17. A device as claimed in claim 15, wherein said camshaft is fitted with a wheel having radial lobes with a predetermined spacing;

said kinematic linkage comprising a first lever and a second lever hinged to each other;

the first lever being hinged at an intermediate point thereof to a fixed support, and being hinged at opposite ends thereof to said second lever and said temperature deformable element, respectively; and said second lever exerting thrust successively on the radial lobes of said wheel to cause said cam shaft to rotate the predetermined angle about the axis of rotation.

18. A device as claimed in claim 17, wherein, whenever said temperature deformable element deforms from said first shape to said at least one second shape, said kinematic linkage imparts to said camshaft a rotational displacement corresponding to the spacing between said radial lobes.

19. A device as claimed in claim 12, further comprising a control circuit for cyclically cutting off supply to said PTC element once sufficient heat has been generated by the PTC element to cause said temperature deformable element to deform from said first shape to said at least one second shape.

20. A device as claimed in claim 19, wherein said control circuit comprises an electronic switch interposed between said control unit and said PTC element to selectively cut off supply to said PTC element in response to a signal supplied from said thermally activated actuator to said electronic switch.

* * * * *